US009255451B2

(12) United States Patent
Rahn et al.

(10) Patent No.: US 9,255,451 B2
(45) Date of Patent: Feb. 9, 2016

(54) TUBE LOCKING MECHANISM FOR DOWNHOLE COMPONENTS

(71) Applicant: Baker Hughes Incorporated, Houston, TX (US)

(72) Inventors: Henning Rahn, Celle (DE); Ingo Roders, Seelze (DE); Detlev Benedict, Celle (DE); Robert Buda, Lower Saxony (DE); Rene Schulz, Lower Saxony (DE); Stephan Mueller, Hannover (DE); Volker Peters, Wienhausen (DE); Helmut Floerke, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 448 days.

(21) Appl. No.: 13/753,205

(22) Filed: Jan. 29, 2013

(65) Prior Publication Data

US 2014/0209296 A1 Jul. 31, 2014

(51) Int. Cl.
*E21B 17/02* (2006.01)

(52) U.S. Cl.
CPC ..... *E21B 17/023* (2013.01)

(58) Field of Classification Search
CPC ..... E21B 17/03; E21B 17/046
See application file for complete search history.

(56) References Cited

U.S. PATENT DOCUMENTS

| | | | |
|---|---|---|---|
| 4,971,147 | A | 11/1990 | Thomeer |
| 5,435,395 | A | 7/1995 | Connell |
| 6,830,467 | B2 | 12/2004 | Hall et al. |
| 6,982,384 | B2 | 1/2006 | Hall et al. |
| 7,299,867 | B2 | 11/2007 | Hall et al. |
| 8,118,093 | B2 | 2/2012 | Hassell et al. |
| 2002/0005282 | A1 | 1/2002 | Holbert |
| 2002/0135179 | A1 | 9/2002 | Boyle et al. |
| 2004/0149471 | A1 | 8/2004 | Hall |
| 2004/0150533 | A1 | 8/2004 | Hall |
| 2004/0244964 | A1 | 12/2004 | Hall |
| 2005/0001736 | A1 | 1/2005 | Hall |
| 2005/0045339 | A1 | 3/2005 | Hall |
| 2005/0145406 | A1 | 7/2005 | Hall et al. |
| 2006/0158296 | A1 | 7/2006 | Hall et al. |
| 2008/0106433 | A1 | 5/2008 | Madhavan et al. |
| 2009/0126162 | A1 | 5/2009 | Head et al. |
| 2010/0111592 | A1* | 5/2010 | Hassell et al. ..... 403/24 |
| 2010/0230802 | A1* | 9/2010 | Benjavasukul et al. ..... 257/693 |
| 2010/0307748 | A1* | 12/2010 | Casciaro et al. ..... 166/277 |

FOREIGN PATENT DOCUMENTS

KR 101223221 B1 1/2013

OTHER PUBLICATIONS

Notification of Transmittal of the International Search Report and the Written Opinion of the International Searching Authority, or the Declaration; PCT/US2014/013564; May 9, 2014, 16 pages.
Dieter Muhs et al.: "Roloff/Matek Maschinenelemente"; Vieweg publisher, 1963, German 17th edition (2005); pp. 368-373.
Hernandez, "The Evolution and Potential of networked Pipe", Technology Update, JPT, Apr. 2010. pp. 26-28.
Notification of Transmittal of the International Search Report and the Written Opinion of the International Searching Authority, or the Declaration; PCT/US2014/013556; May 19, 2014, 15 pages.

* cited by examiner

*Primary Examiner* — William P Neuder
(74) *Attorney, Agent, or Firm* — Cantor Colburn LLP

(57) ABSTRACT

An apparatus for securing a transmission line in a downhole component includes: an element coupled to an exterior surface of the transmission line, the transmission line configured to be disposed in a communication conduit that extends through the downhole component, the element configured to restrict axial movement of the transmission line within the communication conduit.

20 Claims, 6 Drawing Sheets

TUBE LOCKING MECHANISM FOR DOWNHOLE COMPONENTS

BACKGROUND

During subterranean drilling and completion operations, a borehole string such as a drill pipe or other conduit is lowered into a borehole in an earth formation. Such strings may include various components, such as pipe segments and subassemblies. As the string is lowered into the borehole, additional pipe segments are coupled to the string by various coupling mechanisms, such as threaded couplings.

Various power and/or communication signals may be transmitted through the pipe segments via a "wired pipe" configuration. Such configurations include electrical, optical or other conductors extending along the length of selected pipe segments. Such pipe segments typically include bores or other conduits extending through the segments and/or coupling configurations. Various tubes or other extended devices, such as cables and fluid conduits, are disposed within the bores to provide for, e.g., transmission of communications, actuation mechanisms or fluids through the string.

Transmission lines routed through string components are typically retained under tension, in order to reduce movement within the bore. In the case of data and/or communication lines, the lines may be secured radially and axially at the end of the pipe segment to facilitate connection to transmission lines in other components or pipe segments.

SUMMARY

An apparatus for securing a transmission line in a downhole component includes: an element coupled to an exterior surface of the transmission line, the transmission line configured to be disposed in a communication conduit that extends through the downhole component, the element configured to restrict axial movement of the transmission line within the communication conduit.

A wired downhole component includes: an elongated carrier having a first end including a first coupler and a second end including a second coupler; a transmission line extending between the first coupler and the second coupler and disposed in a communication conduit that extends between the first end and the second end, the transmission line secured to and held in tension between the first coupler and the second coupler; and an element coupled to an exterior surface of the transmission line and configured to restrict axial movement of the transmission line within the communication conduit.

BRIEF DESCRIPTION OF THE DRAWINGS

The following descriptions should not be considered limiting in any way. With reference to the accompanying drawings, like elements are numbered alike.

DETAILED DESCRIPTION

There is provided a locking mechanism to secure a tube such as a cable or other transmission line within a downhole tool communication conduit. The locking mechanism includes an element such as a sleeve that is permanently joined to an exterior surface of the transmission line. In one embodiment, the element includes a shape memory sleeve or ring that is configured to contract during or after deployment of the transmission line to secure the transmission line to the shape memory sleeve to the transmission line and allow for axial restriction of the transmission line within the communication conduit. In other embodiments, the element includes one or more deformable elements such as a constriction sleeve or a snap sleeve that is configured to engage the permanently joined sleeve to form an interference fit between the transmission line and the conduit.

Figure 1:
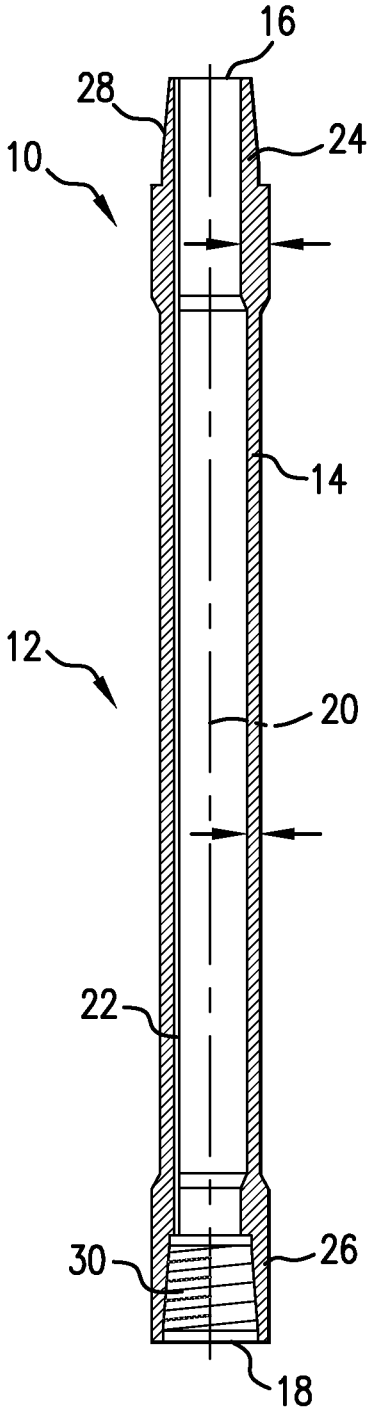
FIG. 1 depicts an embodiment of a downhole component for use in downhole operation such as a well drilling, completion and/or logging operation.

Referring to FIG. 1, an exemplary embodiment of a portion of a well drilling, logging, completion and/or production system 10 includes a conduit or string 12, such as a drillstring or production string, that is configured to be disposed in a borehole for performing operations such as drilling the borehole, making measurements of properties of the borehole and/or the surrounding formation downhole, and facilitating hydrocarbon production.

The string 12 includes at least one string or pipe segment 14 having a first end 16 and a second end 18. An inner bore or other conduit 20 extends along the length of each segment 14 to allow drilling mud or other fluids to flow therethrough. A communication conduit 22 is located within the segment 14 to provide protection for electrical, optical or other conductors to be disposed along the segment 14.

The segment 14 includes a first coupling 24 and a second coupling 26. The first coupling 24 includes a male coupling portion 28 having an exterior threaded section, and is referred to herein as a "pin" 24. The second coupling 26 includes a female coupling portion 30 having an interior threaded section, and is referred to herein as a "box" 26.

At least an inner bore or other conduit 20 extends along the length of each segment 14 to allow drilling mud or other fluids to flow therethrough. In one embodiment, the segment 14 is a wired pipe segment or other component that includes a transmission line including electrical, optical or other conductors. For example, the transmission line is a coaxial cable, fiber optic cable or other type of communication line. The communication conduit 22, such as an axial bore or an elongated passage disposed on a surface of the segment 14 or the bore 22, extends along the segment from the first end 16 to the second end 18 and houses at least a portion of a transmission line.

Although the conduit 22 is referred to as a communication conduit, it is not so limited. For example, the conduit 22 may be configured to house and protect any elongated member that extends through at least a portion of the segment 14. For example, the conduit may be configured to house hydraulic fluid or sample fluid lines. Thus, "transmission line" refers to any elongated component that can be inserted into the conduit 22 and provides some form of communication (e.g., data, power, electrical signals, optical signals and/or fluid) between downhole components.

In one embodiment, the system 10 is operably connected to a downhole or surface processing unit which may act to control various components of the system 10, such as drilling, logging and production components or subs. Other components include machinery to raise or lower segments 14 and operably couple segments 14, and transmission devices. The downhole or surface processing unit may also collect and process data generated by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

FIGS. 2-9 show embodiments of a locking mechanism that is configured to be inserted into the communication conduit 22 with a transmission line 32, and may be actuated to restrict radial movement of a transmission line 32 within the conduit 22. The locking mechanism may also include features configured to restrict axial movement of the transmission line and/or transmit axial loads from the transmission line 32. The locking mechanism includes at least one feature, such as a sleeve, that is permanently joined to the transmission line and is configured to engage the communication conduit 22 to prevent or restrict radial and/or axial movement and support high tensile loads from the transmission line 32.

At least some parts of the locking mechanism can be freely advanced through the conduit 22 along with the transmission line 32 prior to actuating the locking mechanism or otherwise engaging the locking mechanism with the communication conduit to prevent or restrict movement, and the conduit 22 need not be specially designed to accept the locking mechanism. The assembled locking mechanism is capable of carrying high tensile loads (e.g., on the order of the rupture load of the transmission line itself), does not damage the communication conduit inside the downhole component, and is designed for small installation spaces typically involved in downhole operations. In addition, because the locking mechanism includes an element that is distinct from the transmission line, the locking mechanism can be easily attached to and deployed with the transmission line without having to make any significant alterations to the transmission line itself and/or the communication conduit, and thus can be assembled with pre-existing conduits and/or transmission lines.

In one embodiment, the locking mechanism is configured to be actuated to increase its outer diameter or otherwise engage the surface of the conduit 22 and secure the transmission line 32 radially and/or axially within the conduit 22. In one embodiment, the locking mechanism encloses the transmission line 32 along a selected portion of the transmission line 32. For example, the locking mechanism may be positioned to support the transmission line at various locations between the locations at which the transmission line is secured at the first end 16 and the second end 18 of the tool 12. The locking mechanism may also form all or part of an assembly to secure the transmission line 32 to couplers at the first and/or second ends. Exemplary couplers include inductive coils, direct electrical contacts and optical connection rings.

In one embodiment, at least one element of the locking mechanism is a component separate from the transmission line 22 that is mechanically joined to the transmission line by a permanent mechanical joining, such as a weld, an adhesive, or solder. As described herein, "permanently joined" is defined as being joined such that the element is mechanically joined to a surface of the transmission line via a connection that prevents relative movement between the element and the transmission line surface without including a feature (e.g., bolts) that provides a mechanism for disconnecting the elements.

Figure 2:
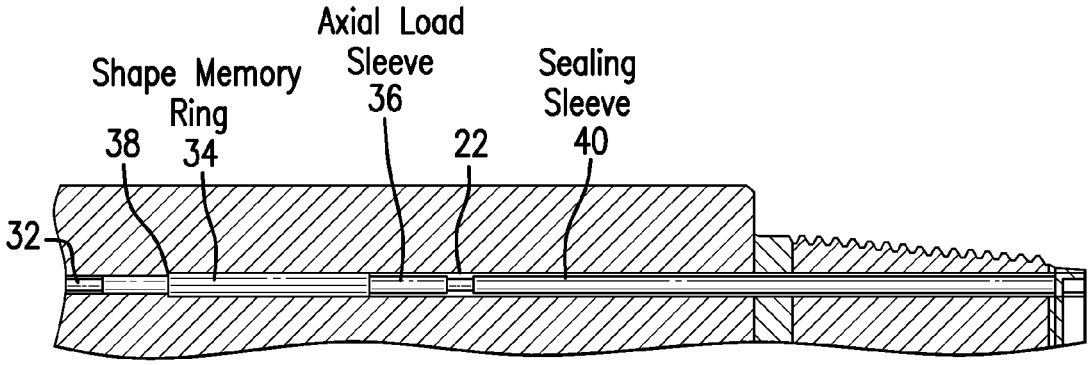
FIG. 2 depicts a portion of a downhole component including a communication channel and an embodiment of a locking mechanism disposed in the channel.
Figure 3:
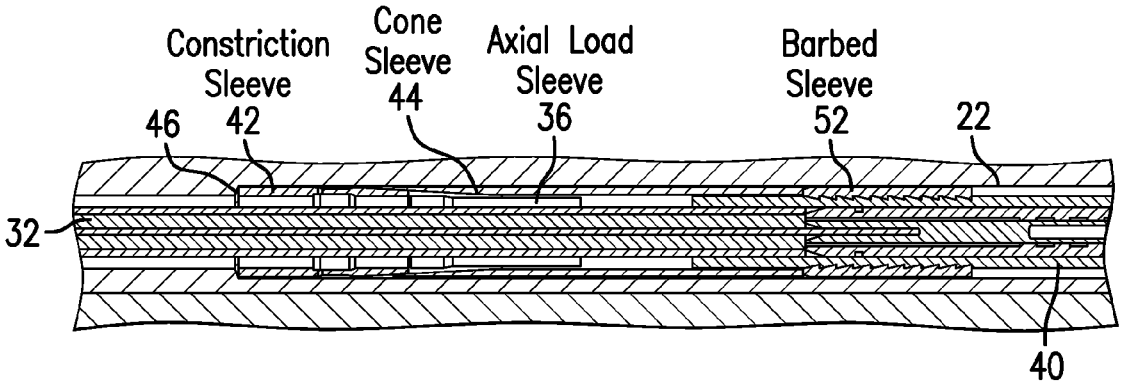
FIG. 3 depicts a portion of a downhole component including a communication channel and an embodiment of a locking mechanism disposed in the channel from a side cut.

Referring to FIG. 2, an embodiment of the locking mechanism includes a shape memory element 34, such as a shape memory sleeve or ring, that is positioned around a section of the transmission line 32 and can be activated downhole to compress against the transmission line 32 and lock the transmission line 32 to the conduit 22 through contact pressure and friction between the shape memory sleeve and the transmission line, e.g., via a press fit or interference fit. The shape memory element 34 can be formed from any suitable shape memory material, such as Shape Memory Polymers (SMP) that have the ability to return from a deformed state to their original shape prior to deformation in response to a stimulus such as a temperature change, an electric or magnetic field, electromagnetic radiation, and a change in pH. Non-limiting examples of shape memory materials include Shape Memory Polymers (SMP), such as polyurethane or epoxy SMPs, which may have properties ranging from, for example, stable to biodegradable, soft to hard, and elastic to rigid, depending on the structural units that constitute the SMP. SMPs may also include thermoplastic and thermoset (covalently cross-linked) polymeric materials. SMPs may also be able to store multiple shapes in memory. Examples of SMPs include polyurethane, polyurethane foams, epoxies, polyamides, polyvinyl alcohols, vinyl alcohol-vinyl ester copolymers, phenolic polymers, and polybenzimidazoles.

As shown in FIG. 2, the shape memory element 34 may be disposed directly around the transmission line 32, or may be disposed around an axial load sleeve 36 that is permanently joined (e.g., attached via welding or bonding) to an outer surface of the transmission line. It is noted that the shape memory element 34 may optionally be permanently joined to the transmission line 32 or the axial load sleeve 36.

In use, the shape memory element 34 is heat treated and expanded or otherwise formed into a deployment shape in which the inner diameter of the shape memory element 34 is approximately equal to or greater than the diameter of the transmission line 32. The shape memory element may then be inserted into the conduit 22 with the transmission line 32, inserted before the transmission line 32 or inserted after the transmission line 32. After deployment into the conduit 22 and/or deployment of the downhole component, a suitable trigger is applied to cause the shape memory element 34 to contract and exert pressure against the transmission line 32 and grip or otherwise be fixedly positioned relative to the transmission line. The trigger may be a thermal trigger such as the downhole temperature, or may be an actively applied trigger such as a heat source or an electromagnetic source.

In one embodiment, the locking mechanism includes a mechanism for axially securing the transmission line 32 and transmitting an axial load to the downhole component. For example, the shape memory element 34 and/or the axial load sleeve 36 is welded, bonded or otherwise permanently joined to the transmission line 32, and forms a shoulder 38 that is configured to contact and rest against a shoulder or other feature formed on the conduit 22. In another example, the shape memory element 34 and/or the axial load sleeve 36 is removably secured to the transmission line, e.g., using bolts or other securing mechanism.

In this embodiment, the locking mechanism may be inserted into a section of the conduit 22 so that the shoulder 38 abuts a feature in the conduit. An exemplary feature includes an obstruction or protrusion formed by the interior surface of the conduit or attached to the interior surface of the conduit. The feature, in one example, is a conduit shoulder formed by an increased-diameter section of the conduit 22, but is not so limited. The feature may be any feature in the conduit configured to engage the shoulder 38 and restrict axial movement.

The shoulder 38 on the outer diameter of the transmission line 32 can be realized, for example, with the axial load sleeve 36 as shown in FIG. 2, which is configured as a permanently joined (e.g., welded, brazed or glued) sleeve. Other examples of shoulders include a plastically deformed tube or a build-up welded diameter change. The shoulder 38 is not restricted to the embodiments described herein.

Additional positioning, securing and/or connecting component may be included as part of the locking mechanism to further secure or protect the transmission line 32. For example, a sealing sleeve 40 may be inserted around the transmission line 32 to provide protection to sections of the transmission line 32.

Figure 4:
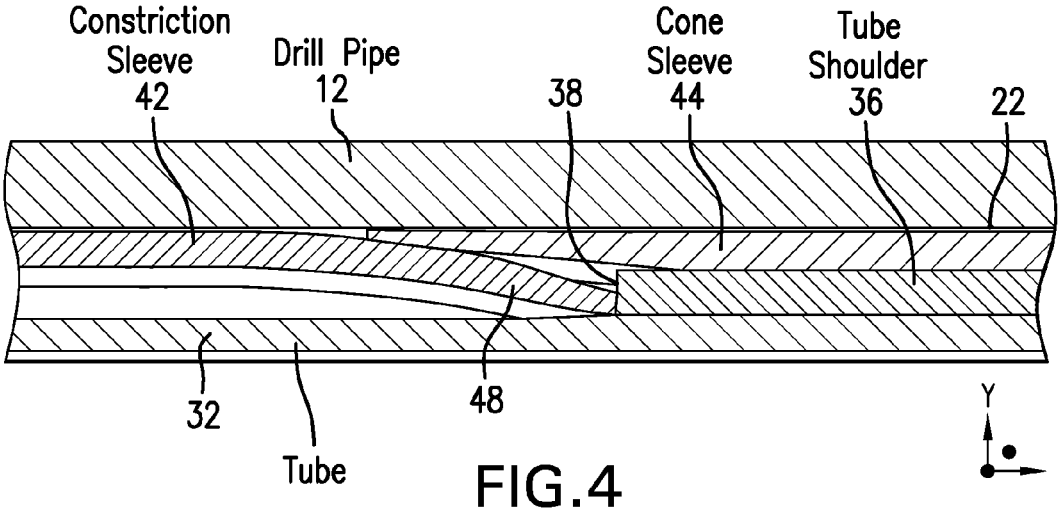
FIG. 4 is a close-up view of an embodiment of the locking mechanism of FIG. 3 in an actuated position.

Referring to FIGS. 3-6, an embodiment of the locking mechanism includes elements that cooperate to form a form fit between the transmission line 32 and the conduit 22. In this embodiment, a deformable constriction sleeve 42 cooperates with a cone sleeve 44 and an axial load sleeve 36 to provide both axial and radial support to the transmission line 32. The constriction sleeve 42 is configured to abut an obstruction 46 on the interior surface of the conduit 22 (e.g., a shoulder formed between an increased diameter section and a smaller diameter section of the conduit 22). Actuation of the locking mechanism is achieved by axially sliding the cone sleeve 44 over the constriction sleeve 42 (as shown in FIG. 4), thereby causing deformable or flexible portion(s) 48 to move radially inward and engage a shoulder 38 that prevents movement of the transmission line 32 and transmits the tensile load through a form fit. In one embodiment, the constriction sleeve 42 includes features such as slots 50 to increase the flexibility of the constriction sleeve 42.

Figure 5:
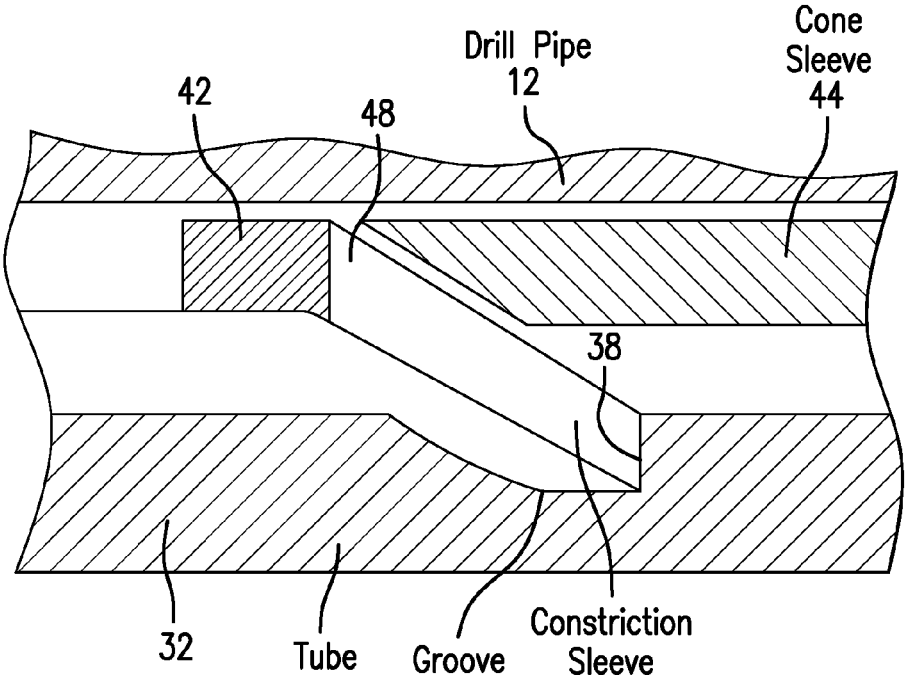
FIG. 5 is a close-up view of an embodiment of the locking mechanism of FIG. 3 in an actuated position.
Figure 6:
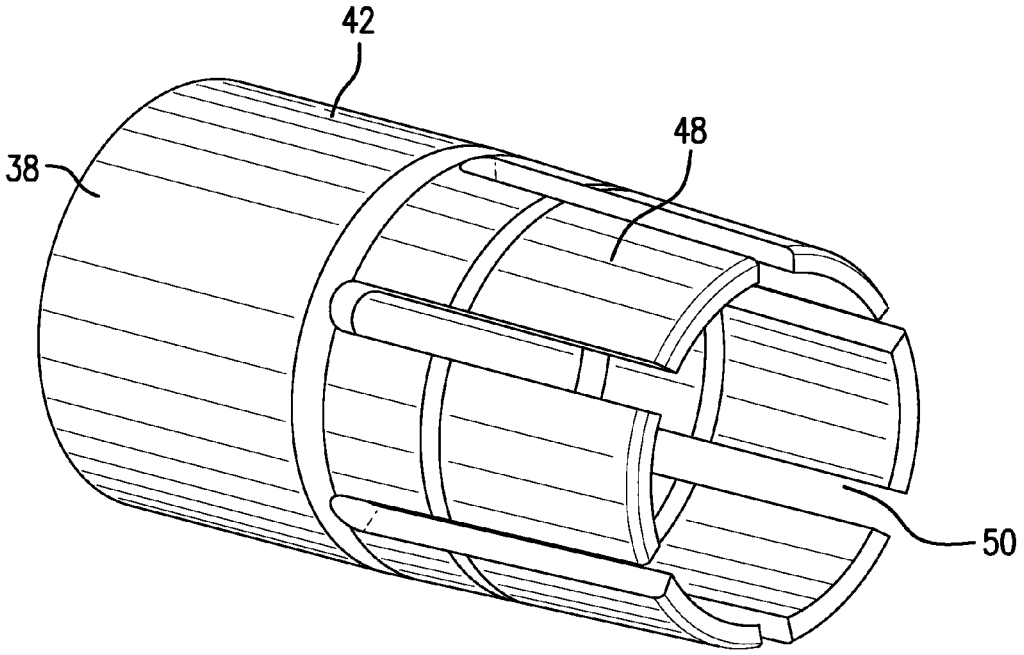
FIG. 6 depicts an exemplary constriction sleeve of the locking mechanism of FIG. 3.

In one embodiment, an example of which is shown in FIG. 4, the shoulder 38 is formed by the axial load sleeve 36 that is secured to the transmission line 32. In another embodiment, an example of which is shown in FIG. 5, the shoulder 38 is formed as a groove in the transmission line 32 or is otherwise configured as an integral part of the transmission line 32 (e.g., part of a cable jacket or other outer layer of the transmission line 32).

Additional sleeves or components may be used to further axially secure the locking mechanism. For example, a barbed sleeve 52 may be inserted during or after activation of the locking mechanism to secure the constriction sleeve 42 in an activated position. The barbs of the barbed sleeve cut into the surface or otherwise grip the surface of the transmission line 32 (or the sealing sleeve 40) to restrict movement.

Figure 7:
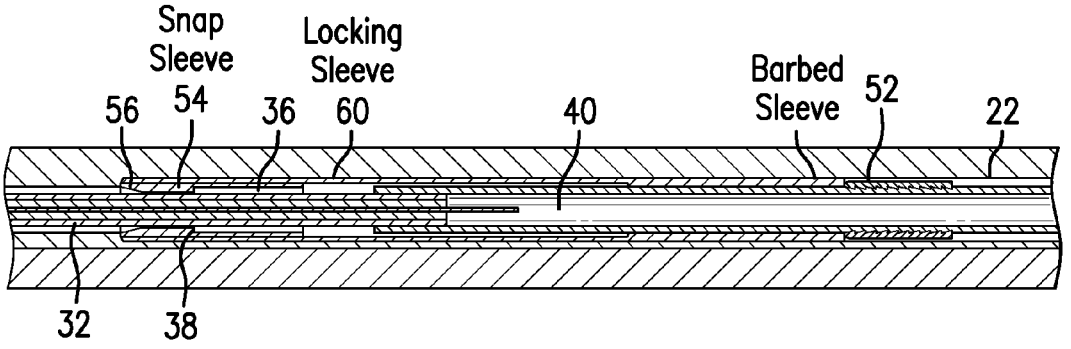
FIG. 7 depicts a cross-sectional view of a portion of a downhole component including a communication channel and an embodiment of a locking mechanism disposed in the channel.
Figure 8:
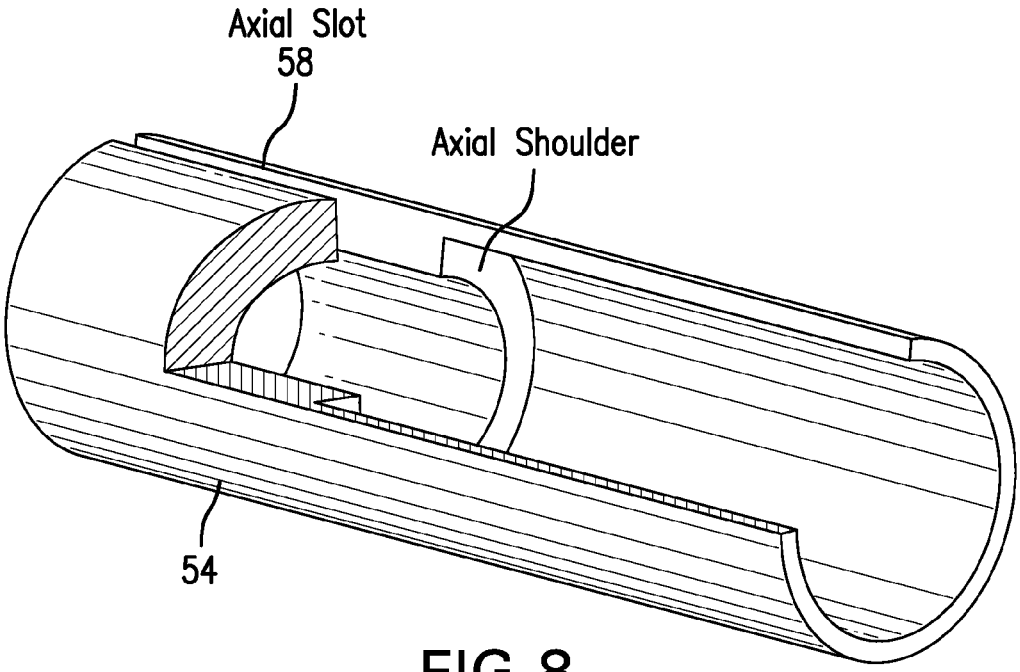
FIG. 8 depicts an exemplary snap sleeve of the locking mechanism of FIG. 6.

Referring to FIGS. 7-8, an embodiment of the locking mechanism includes a deformable or elastic snap sleeve 54 that interacts with a shoulder 38 on the transmission line 32 and/or the axial load sleeve 36 to provide a form fit. The snap sleeve 54 elastically widens during axial sliding of a tapered end 56 over the axial load sleeve 36 (or other increased diameter portion of the transmission line 32) and deforms back after passing the shoulder 38. In one embodiment, the snap sleeve includes an axial slot 58 that allows the snap sleeve 54 to widen. The axial load sleeve 36 and/or transmission line 32 interacts with the snap sleeve 54 via a form fit. Additional elements, such as a locking sleeve 60 and a barbed sleeve 52 (shown in FIG. 6), may be included to secure the position of the snap sleeve 54 after its activation.

Figure 9:
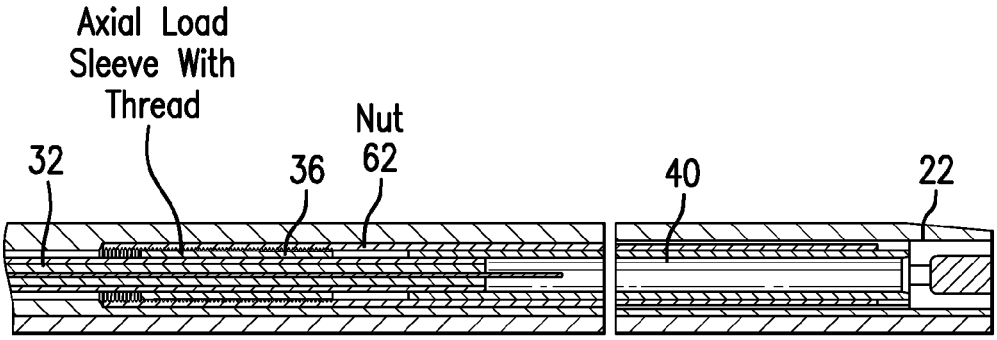
FIG. 9 depicts a portion of a downhole component including a communication channel and an embodiment of a locking mechanism disposed in the channel.

Referring to FIG. 9, in one embodiment, the locking mechanism includes a feature such as the axial load sleeve that includes an external threaded section. The threaded section is configured to engage a nut 62, sleeve or other component that includes an interior threaded section. The tensile load is transmitted by the threaded connection from the transmission line 32 to the nut 62. In one embodiment, the nut 62 is configured to be screwed against a shoulder, obstruction or other feature in the conduit 22 to restrict axial movement.

Figure 10:
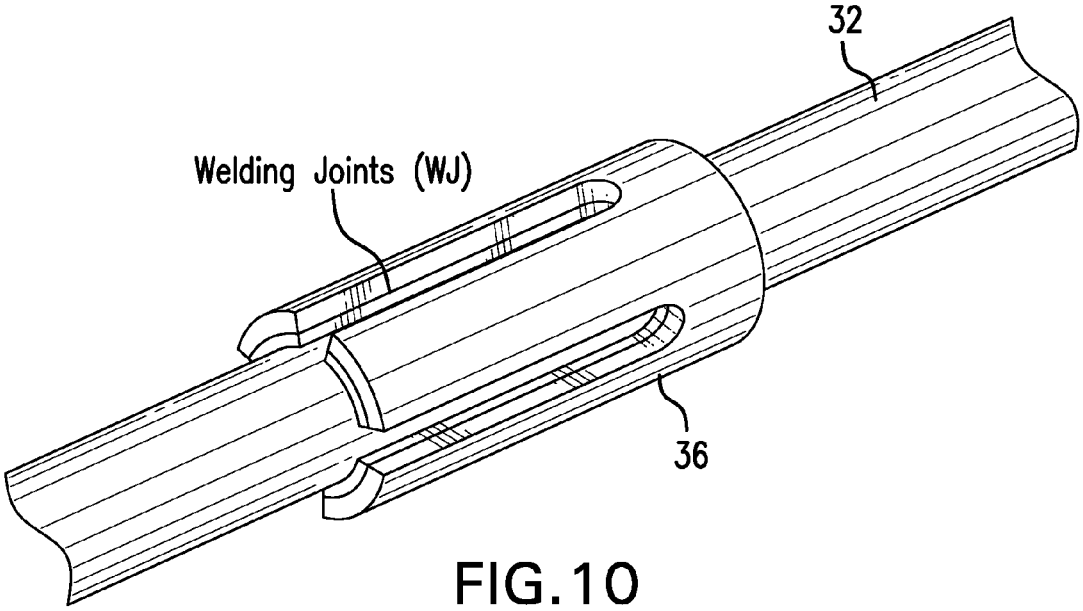
FIG. 10 depicts an embodiment of an axial load sleeve permanently joined to a transmission line configured to be disposed in a communication channel of a downhole component.

FIG. 10 shows an example of the axial load sleeve 36 that is welded, brazed, glued or otherwise permanently attached to an outer surface of the transmission line 32. In one embodiment, the sleeve 36 includes axial slots to increase the welded or joined length. The sleeve provides an external diameter that corresponds to an internal diameter of the conduit 22 to prevent axial movement, and may also be configured to interact with or engage a shoulder (e.g., a changed diameter) or other feature in the conduit 22.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for securing a transmission line in a downhole component, comprising:

a first element coupled to an exterior surface of the transmission line, the transmission line configured to be disposed in a communication conduit that extends through the downhole component, the first element attached to the transmission line so that the first element advances with the transmission line through the communication conduit; and at least one deformable element configured to be disposed in the communication conduit and actuated to secure the transmission line within the communication conduit, wherein the at least one deformable element is actuated by deforming the at least one deformable element to engage the first element and restrict at least axial movement of the transmission line.

2. The apparatus of claim 1, wherein the first element is permanently joined to the exterior surface.

3. The apparatus of claim 1, wherein the first element is formed as an integral part of the transmission line.

4. The apparatus of claim 1, wherein the transmission line is configured to be secured to a first coupler at a first end of the downhole component and secured to a second coupler at a second end of the downhole component, the transmission line configured to be held in tension between the first end and the second end.

5. The apparatus of claim 1, wherein at least one of the first element and the at least one deformable element includes a shape memory element surrounding a section of the transmission line.

6. The apparatus of claim 5, wherein the shape memory element is configured to be deployed with the transmission line in a deployment shape, and actuated to change the shape memory element into a remembered shape and form an interference fit between the transmission line and the shape memory element.

7. The apparatus of claim 5, wherein the first element includes an axial load sleeve disposed between the transmission line and the shape memory element, the axial load sleeve configured to engage an interior surface of the communication conduit to restrict axial movement of the transmission line.

8. The apparatus of claim 1, wherein the first element forms a shoulder that extends radially from the surface and is configured to engage a feature on an interior surface of the communication conduit.

9. The apparatus of claim 8, wherein the shoulder is formed by an axial load sleeve permanently joined to the exterior surface.

10. The apparatus of claim 8, wherein the feature is formed by a transition between an increased diameter portion of the communication conduit and a decreased diameter portion of the communication conduit.

11. The apparatus of claim 8, wherein the at least one deformable element is configured to engage the shoulder upon actuation of the apparatus and form an interference fit to restrict radial movement of the transmission line.

12. The apparatus of claim 11, wherein the at least one deformable element includes a constriction sleeve and a cone sleeve, the constriction sleeve configured to surround the transmission line and configured to engage the shoulder and an interior surface of the communication conduit, the cone sleeve configured to be moved axially and cause the constriction sleeve to constrict radially and engage the shoulder to form an interference fit.

13. The apparatus of claim 12, wherein the constriction sleeve includes a first axial end configured to engage the interior surface of the communication conduit and a second axial end including a deformable portion configured to deform upon axial movement of the cone sleeve.

14. The apparatus of claim 11, wherein the at least one deformable element includes a snap sleeve configured to widen as the snap sleeve is advanced over the shoulder and return to shape and form a form fit.

15. The apparatus of claim 1, wherein the first element includes a sleeve surrounding a portion of the transmission line, the sleeve including an exterior threaded section configured to engage an elongated sleeve including an interior threaded section.

16. A wired downhole component comprising:

an elongated carrier having a first end including a first coupler and a second end including a second coupler;

a transmission line extending between the first coupler and the second coupler and disposed in a communication conduit that extends between the first end and the second end, the transmission line secured to and held in tension between the first coupler and the second coupler; and a first element coupled to an exterior surface of the transmission line; and at least one deformable element configured to be disposed in the communication conduit and actuated to secure the transmission line within the communication conduit, wherein the at least one deformable element is actuated by deforming the at least one deformable element to engaging the first element and restrict at least axial movement of the tranmission line.

17. The wired downhole component of claim 16, wherein at least one of the first element and the at least one deformable element includes a shape memory element surrounding a section of the transmission line.

18. The wired downhole component of claim 16, wherein the first element forms a shoulder that extends radially from the surface and is configured to engage an interior surface of the communication conduit.

19. The wired downhole component of claim 18, wherein the shoulder is formed by an axial load sleeve permanently joined to the exterior surface.

20. The wired downhole component of claim 18, wherein the deformable element is configured to engage the shoulder upon actuation of the apparatus and form an interference fit to restrict radial movement of the transmission line.

* * * * *